US012729874B2

(12) United States Patent
Shao et al.

(10) Patent No.: US 12,729,874 B2
(45) Date of Patent: Sep. 8, 2026

(54) TWO-SUPPLY KITCHEN AIR CONDITIONING SYSTEM

(71) Applicant: Ningbo Dongda Air-Conditioning Equipment Co., Ltd., Yuyao City (CN)

(72) Inventors: Anchun Shao, Yuyao City (CN); Benfeng Zhang, Zhejiang Province (CN); Yang Cao, Beijing (CN); Songchao Shao, Shanghai (CN)

(73) Assignee: Ningbo Dongda Air-Conditioning Equipment Co., Ltd., Yuyao City (CN)

( * ) Notice: Subject to any disclaimer, the term of this patent is extended or adjusted under 35 U.S.C. 154(b) by 190 days.

(21) Appl. No.: 18/405,423

(22) Filed: Jan. 5, 2024

(65) Prior Publication Data

US 2025/0207800 A1 Jun. 26, 2025

(30) Foreign Application Priority Data

Dec. 20, 2023 (CN) ..... 202311761706.5

(51) Int. Cl.
*F24F 11/84* (2018.01)
*F24F 5/00* (2006.01)

(52) U.S. Cl.
CPC ..... *F24F 11/84* (2018.01); *F24F 5/0017* (2013.01)

(58) Field of Classification Search
CPC ..... F24F 11/84; F24F 2005/0025; F24F 5/00; F24F 5/0017; F24F 5/0096
See application file for complete search history.

(56) References Cited

U.S. PATENT DOCUMENTS

| | | | | |
|---|---|---|---|---|
| 10,488,084 | B2 * | 11/2019 | Lu | B64D 13/08 |
| 2003/0205055 | A1 * | 11/2003 | Shahbaz | F24F 8/10 62/331 |
| 2016/0348955 | A1 * | 12/2016 | Ren | F25D 17/065 |
| 2018/0209700 | A1 * | 7/2018 | Murphy | F24F 5/0017 |
| 2022/0018580 | A1 * | 1/2022 | Kim | F24F 11/36 |
| 2022/0205653 | A1 * | 6/2022 | Yamauchi | F24F 1/36 |
| 2024/0353120 | A1 * | 10/2024 | Shi | F24F 1/50 |

* cited by examiner

*Primary Examiner* — Henry T Crenshaw

(57) ABSTRACT

A kitchen air conditioning system in the field of kitchen air conditioning includes a casing, a refrigeration system, and a thermal storage tank arranged separately from the air-conditioning unit. The refrigeration system comprises a compressor, a water-side heat exchanger, a filter-drier, an expansion valve, an indoor-side heat exchanger, an indoor fan, a electronic thermostat, a temperature sensor, a high-pressure switch, a low-pressure switch, and a controller. A water outlet A and a water inlet A are positioned near the water-side heat exchanger, and a water outlet B and a water inlet B are positioned near the thermal storage tank. The compressor, water-side heat exchanger, condenser, electronic thermostat, and controller are located in a left chamber of the casing, while the indoor-side heat exchanger, expansion valve, filter-drier, and indoor fan are arranged in a right chamber of the casing.

7 Claims, 6 Drawing Sheets

TWO-SUPPLY KITCHEN AIR CONDITIONING SYSTEM

TECHNICAL FIELD

The present invention relates to a kitchen air conditioning system in which an air conditioning unit and a thermal storage tank are separately arranged. The invention belongs to the field of kitchen air-conditioning technology.

BACKGROUND

In order to improve the kitchen operating environment and increase comfort level and pleasantness, small-scale kitchen air conditioners have quietly emerged. Presently, the condensing side of a kitchen air conditioner is basically designed to adopt air cooling. The main reason is that although a water-cooled unit operates stable with a high energy efficiency ratio, it always requires the installation of a cooling tower, which not only occupies space and leads to high initial investment, but also cannot be used during low-temperature winter.

In view of the foregoing situation, kitchen air conditioning systems providing both air conditioning and hot water have appeared, for example;

Patent Publication No. CN 102042713 A discloses a dual-energy-storage air-conditioning hot-water unit that integrates an air conditioner and a water heater to provide cooling, dehumidification, and domestic hot water in a single casing. However, the refrigeration compressor, condenser, evaporator, medium-temperature hot-water tank, high-temperature hot-water tank, and water pump are all installed inside the same casing, resulting in a relatively large volume. Such a configuration is unsuitable for small kitchens, and the hot-water tank cannot be flexibly installed in other rooms such as washrooms or bathrooms, causing inconvenience in hot-water use.

Patent Publication No. CN 109114716 A discloses a kitchen air-conditioning air-energy range-hood integrated unit that performs heat exchange through water circulation and provides hot water. This device also integrates cooling, dehumidification, and domestic hot-water supply. However, its casing contains a heat-exchange water tank, a cold-exchange water tank, and an air-conditioning refrigeration assembly, resulting in a large overall volume that is likewise unsuitable for small kitchens. The hot-water tank similarly cannot be flexibly installed in other required rooms.

Patent Publication No. CN 108895512 A discloses a multifunctional solar triple-supply device integrating hot-water supply, heating, and refrigeration. The outdoor heat exchanger (condenser) is arranged inside a water tank. Due to the restricted length of the refrigerant line between the compressor and condenser, its overall structural limitations resemble those of systems in which the compressor, condenser, and water tank are all arranged in a single casing. Accordingly, the hot-water tank still cannot be installed flexibly in other rooms requiring hot water.

SUMMARY

The purpose of the present invention is to address the defects in the prior art of the above-mentioned kitchen air conditioning systems, specifically the defects that the casing has a relatively large volume, is not suitable for a small-scale kitchen, the hot water tank cannot be installed flexibly in other rooms, and hot water use is inconvenient. The present invention provides a kitchen air conditioning system wherein an air conditioner and a thermal storage tank are separated into arrangement, thereby obtaining the purpose of having a relatively small volume for the casing, being suitable for a small-scale kitchen, and enabling the hot water tank to be installed flexibly in other rooms for convenient hot water use.

The technical solution adopted by the present invention to achieve the above purpose is as follows: A kitchen air conditioning system with an air conditioner and a thermal storage tank be separated into arrangement, suitable for a kitchen, comprising a casing, a refrigeration system, and a thermal storage tank. The refrigeration system comprises a compressor, a water-side heat exchanger, a filter-drier, an expansion valve, an indoor-side heat exchanger, an indoor fan, an electronic thermostat, a temperature sensor, a high-pressure switch, a low-pressure switch, and a controller. The compressor, the high-pressure switch, the water-side heat exchanger, the filter-drier, the expansion valve, the indoor-side heat exchanger, and the low-pressure switch are connected sequentially by refrigerant lines, and the low-pressure switch is further connected to the compressor by a refrigerant line, forming a refrigeration cycle.

The refrigeration system is installed inside the casing. The thermal storage tank uses cooling water to become domestic hot water or be discharged, so that the water temperature coming out of the water-side heat exchanger is maintained within a reasonable range, and can dispense with the installation of a cooling tower, cool down the high-temperature and high-pressure gaseous refrigerant inside the water-side heat exchanger with the cooling water, and obtain a certain subcooling, thereby ensuring that the expansion valve can operate normally even if the ambient temperature has significant fluctuations.

The water-side heat exchanger is provided with a water outlet A and a water inlet A on one side. The thermal storage tank is provided with a water outlet B and a water inlet B on one side. The water outlet A and the water inlet B are connected by a water pipe. The water outlet B and the water inlet A are connected by a water pipe. A water pump is provided on the water pipe connecting the water outlet B and the water inlet A. The refrigeration system ensures the unit operates stably and efficiently, cools down and dehumidifies the kitchen. Meanwhile, the thermal storage tank provides domestic hot water. Consequently, the kitchen air conditioning system consisting of the refrigeration system and the thermal storage tank is formed.

The longitudinal partition is provided in the middle of the casing. The longitudinal partition separates the casing into a left chamber of the casing and a right chamber of the casing. The transverse partition is provided in the middle of the right chamber of the casing. The portion of the right chamber of the casing above the transverse partition is the upper right chamber of the casing, and the portion of the right chamber of the casing below the transverse partition is the lower right chamber of the casing. The left chamber of the casing is provided with a rear lower portion and a front lower portion.

The compressor is provided in the rear lower portion of the left chamber of the casing. The bottom of the compressor is fixedly arranged on the bottom of the casing. The water-side heat exchanger, i.e., the condenser, is provided in the front lower portion of the left chamber of the casing. The bottom of the water-side heat exchanger is fixedly arranged on the bottom of the casing. The electronic thermostat is fixedly arranged on the left side wall of the left chamber of the casing. The high-pressure switch is provided on the refrigerant line between the compressor and the water-side heat exchanger in the left chamber of the casing. The low-pressure switch is provided on the refrigerant line between the indoor-side heat exchanger and the compressor in the left chamber of the casing. The controller is fixedly arranged on the inner side wall of the left chamber of the casing.

The indoor-side heat exchanger, i.e., the evaporator, is obliquely arranged above the transverse partition in the right chamber of the casing. The expansion valve is provided below the indoor-side heat exchanger. The filter-drier is provided in the lower right chamber of the casing, and the filter-drier is located directly below the expansion valve within the lower right chamber of the casing. The indoor fan is fixedly arranged in the lower right chamber of the casing.

The automatic make-up valve is provided on the upper side of the thermal storage tank. The product model of the automatic make-up valve is AF0522A. If the water level inside the thermal storage tank decreases to a certain extent due to hot water discharge, the automatic make-up valve opens, automatically replenishes water from the tap water pipe, and automatically closes when the replenishment is complete.

The domestic hot water outlet pipe is provided on an upper location on one side of the thermal storage tank. The motorized valve is provided on the domestic hot water outlet pipe. When the water temperature inside the thermal storage tank reaches the set temperature, hot water can be discharged for use by opening the motorized valve. The product model of the motorized valve is Q41F-15. The temperature sensor is provided on one side of the motorized valve. The product model of the temperature sensor is PT-100.

The blowdown valve is provided on a lower location on one side of the thermal storage tank. When sludge is deposited on the bottom of the thermal storage tank, the sludge can be discharged by opening the blowdown valve. The product model of the blowdown valve is DN15.

The electric auxiliary heater is provided on the bottom of one upper side of the thermal storage tank, above the blowdown valve. When the water temperature inside the thermal storage tank has not reached the set temperature, the electric auxiliary heater automatically opens for heating through the controller. When the water temperature reaches the set temperature, the electric auxiliary heater closes again. The product model of the electric auxiliary heater is EHC15/20-3.

The compressor, the indoor fan, the water pump, the automatic make-up valve, the motorized valve, the blowdown valve, the electronic thermostat, the high-pressure switch, and the low-pressure switch are all electrically connected to the controller.

The specific working process of the refrigeration system and the water-side cooling system is as follows:

(1) Refrigeration operation of the refrigeration system carnot cycle:

The low-temperature and low-pressure gaseous refrigerant is compressed and output as high-temperature and high-pressure gaseous refrigerant after compression by the compressor. The refrigerant enters the water-side heat exchanger and is condensed into high-temperature and high-pressure liquid state. The refrigerant then filters through the filter-drier to prevent clogging of the expansion valve, changes into low-temperature and low-pressure two-phase flow through the expansion valve, enters the indoor-side heat exchanger (the evaporator) to absorb heat and evaporate and vaporize into low-temperature and low-pressure gaseous refrigerant, and then returns to the compressor for gaseous compression, outputting high-temperature and high-pressure gaseous refrigerant. This process repeatedly circulates and operates to deliver cooling capacity to the indoor area to achieve the purpose of refrigeration. If, during this cycle, the refrigeration system experiences excessively high pressure or excessively low pressure and reaches the set limit for protection due to some reason, the high-pressure switch or the low-pressure switch will immediately actuate to cut off the power supply. The controller issues a command to shut down, thus protecting the refrigeration system from damage.

(2) Hot water supply operation of the water-side cooling system cycle:

(3) First, the water pump is activated to send the water from the thermal storage tank into the water-side heat exchanger. Then, the water-side cooling system is activated. The high-temperature and high-pressure gaseous refrigerant inside the water-side heat exchanger absorbs heat from the water, thereby cooling down and turning into high-temperature and high-pressure liquid state and obtaining a certain subcooling, ensuring the unit operates stably. Meanwhile, the water heats up after absorbing heat inside the water-side heat exchanger and returns to the thermal storage tank. This cycle repeats.

The water temperature setting in the thermal storage tank and the opening and closing of the domestic hot water motorized valve are controlled by the electronic thermostat. When the temperature sensor senses that the temperature reaches the set temperature, such as 35° C., the motorized valve opens and the domestic hot water can be used or injected into a hot water storage tank preset by the user for storage and future use. If the water level inside the thermal storage tank decreases to a certain extent due to hot water discharge, the automatic make-up valve opens to automatically replenish water from the tap water pipe, and automatically closes when the replenishment is complete.

When the water temperature inside the thermal storage tank is lower than a certain set value, such as 30° C., the electronic thermostat issues a command to close the motorized valve, and the domestic hot water cannot be used. However, the hot water inside the hot water storage tank preset by the user can be used. If the water temperature of the hot water tank does not meet the requirements for use, the electric auxiliary heater is started to heat up the water, and the power supply is automatically cut off to stop heating after the use temperature is reached.

Compared with the prior art, the beneficial effect of the present invention is that it provides a kitchen air conditioning system wherein an air conditioner and a thermal storage tank are separately arranged, thereby obtaining the purpose of having a relatively small volume for the casing, being suitable for a small-scale kitchen, and enabling the hot water tank to be installed flexibly in other rooms, such as washrooms and toilets, for convenient hot water use. Meanwhile, the present invention both delivers cooling capacity to cool down the kitchen and provides domestic hot water, achieving "two uses for one water" which is convenient and hygienic. The unit operates stably, dispenses with the installation of a cooling tower, saves the installation space, and the environmental protection and energy saving effect is significant.

Figure 1:
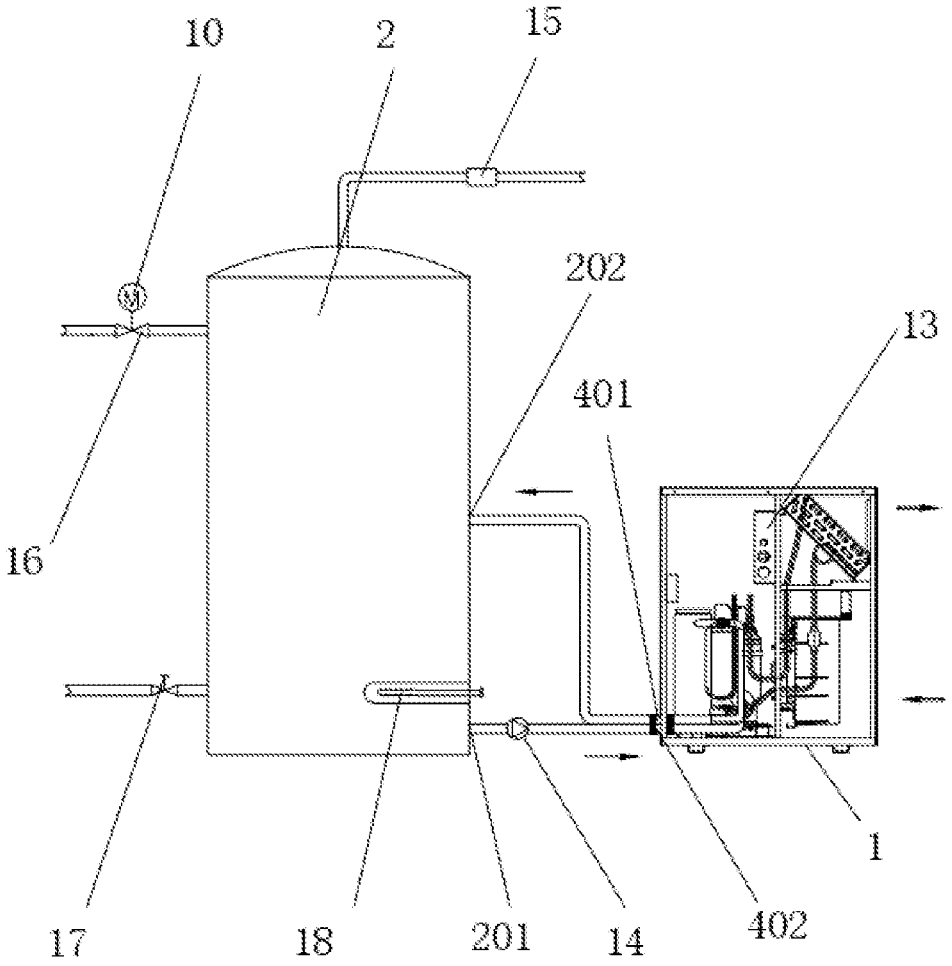
FIG. 1 is an assembly drawing of the refrigeration system and the thermal storage tank of the present invention.

Description of reference numerals: casing 1; longitudinal partition 101; left chamber of the casing 102; right chamber of the casing 103; transverse partition 104; thermal storage tank 2; water outlet B 201; water inlet B 202; compressor 3; water-side heat exchanger 4; water outlet A 401; water inlet A 402; filter-drier 5; expansion valve 6; indoor-side heat exchanger 7; indoor fan 8; electronic thermostat 9; temperature sensor 10; high-pressure switch 11; low-pressure switch 12; controller 13; water pump 14; automatic make-up valve 15; motorized valve 16; blowdown valve 17; electric auxiliary heater 18.

DETAILED DESCRIPTION OF THE EMBODIMENTS

With reference to FIGS. 1 to 6, the embodiments of the present invention are described in detail below. It should be understood that the embodiments described herein are only part of the embodiments of the present invention, and not all of them. Based on the embodiments of the present invention, other embodiments obtained by those skilled in the art without creative work also fall within the scope of protection of the present invention.

As shown in FIGS. 1 to 6, the kitchen air conditioning system in which the air conditioner and the thermal storage tank are arranged separately is suitable for kitchen use. As shown in FIGS. 1 to 5, the system comprises a casing 1, a refrigeration system, and a thermal storage tank 2. The refrigeration system comprises a compressor 3, a water-side heat exchanger 4, a filter-drier 5, an expansion valve 6, an indoor-side heat exchanger 7, an indoor fan 8, an electronic thermostat 9, a temperature sensor 10, a high-pressure switch 11, a low-pressure switch 12, and a controller 13. The compressor 3, the high-pressure switch 11, the water-side heat exchanger 4, the filter-drier 5, the expansion valve 6, the indoor-side heat exchanger 7, and the low-pressure switch 12 are sequentially connected by refrigerant lines, and the low-pressure switch 12 is further connected to the compressor 3 by a refrigerant line, forming a refrigeration cycle.

Figure 6:
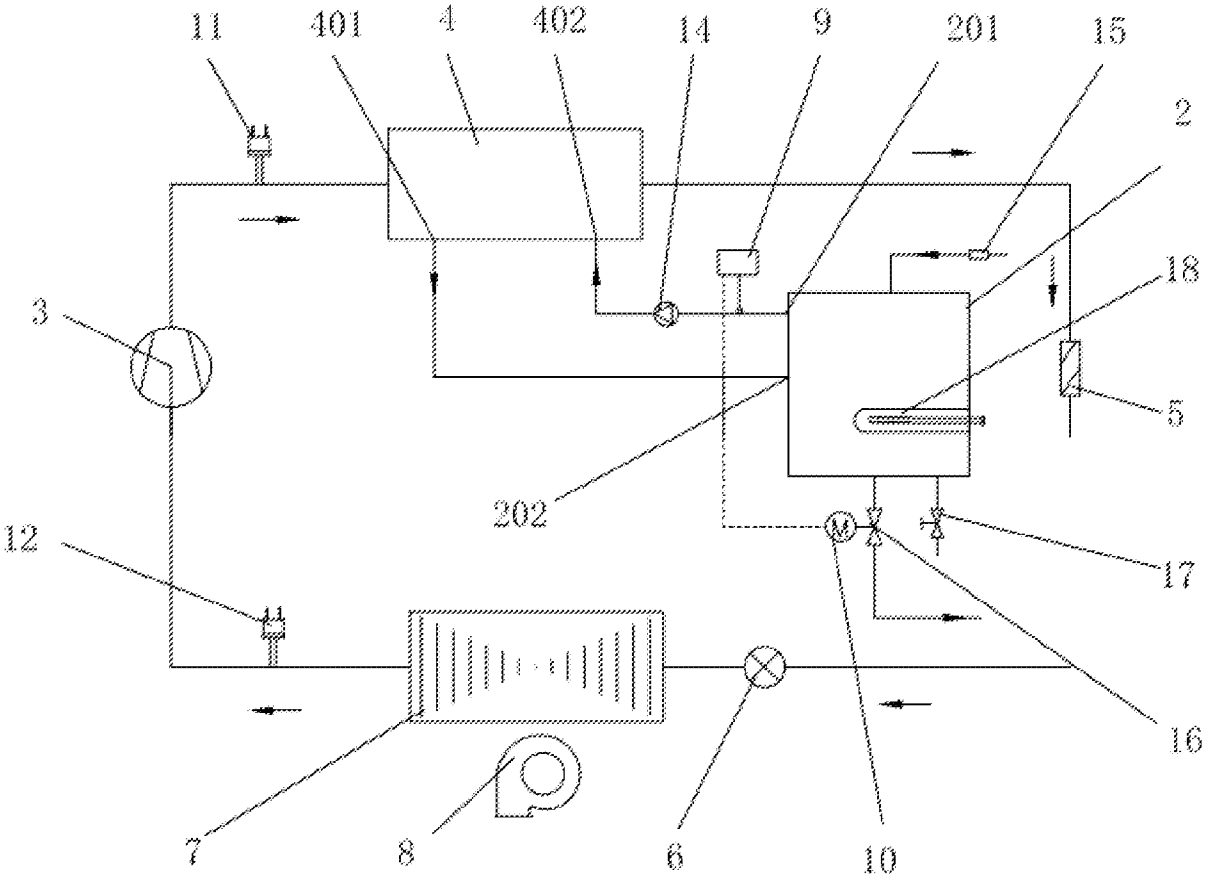
FIG. 6 is a schematic diagram of the present invention (a connection diagram of the components of the refrigeration system and the thermal storage tank).

As shown in FIGS. 1 and 6, the kitchen air conditioning system of the present invention is divided into two parts as a whole: one part is the casing 1 and the refrigeration system installed inside it; the other part is the thermal storage tank 2. The thermal storage tank 2 uses cooling water to become domestic hot water or to discharge water, maintaining the outlet-water temperature of the water-side heat exchanger 4 within a reasonable range. This eliminates the need for a cooling tower and uses cooling water to cool the high-temperature and high-pressure gaseous refrigerant inside the water-side heat exchanger 4, allowing the refrigerant to obtain a certain degree of subcooling and ensuring proper operation of the expansion valve 6 even under large ambient-temperature fluctuations.

A water outlet A 401 and a water inlet A 402 are provided on one side of the water-side heat exchanger 4, and a water outlet B 201 and a water inlet B 202 are provided on one side of the thermal storage tank 2. The water outlet A 401 and the water inlet B 202 are connected by a water pipe, and the water outlet B 201 and the water inlet A 402 are connected by a water pipe. A water pump 14 is arranged on the water pipe connecting the water outlet B 201 and the water inlet A 402. The refrigeration system ensures stable and efficient operation to cool and dehumidify the kitchen, while the thermal storage tank 2 provides domestic hot water. Together, they form a kitchen air conditioning system composed of the refrigeration system and the thermal storage tank 2.

Figure 2:
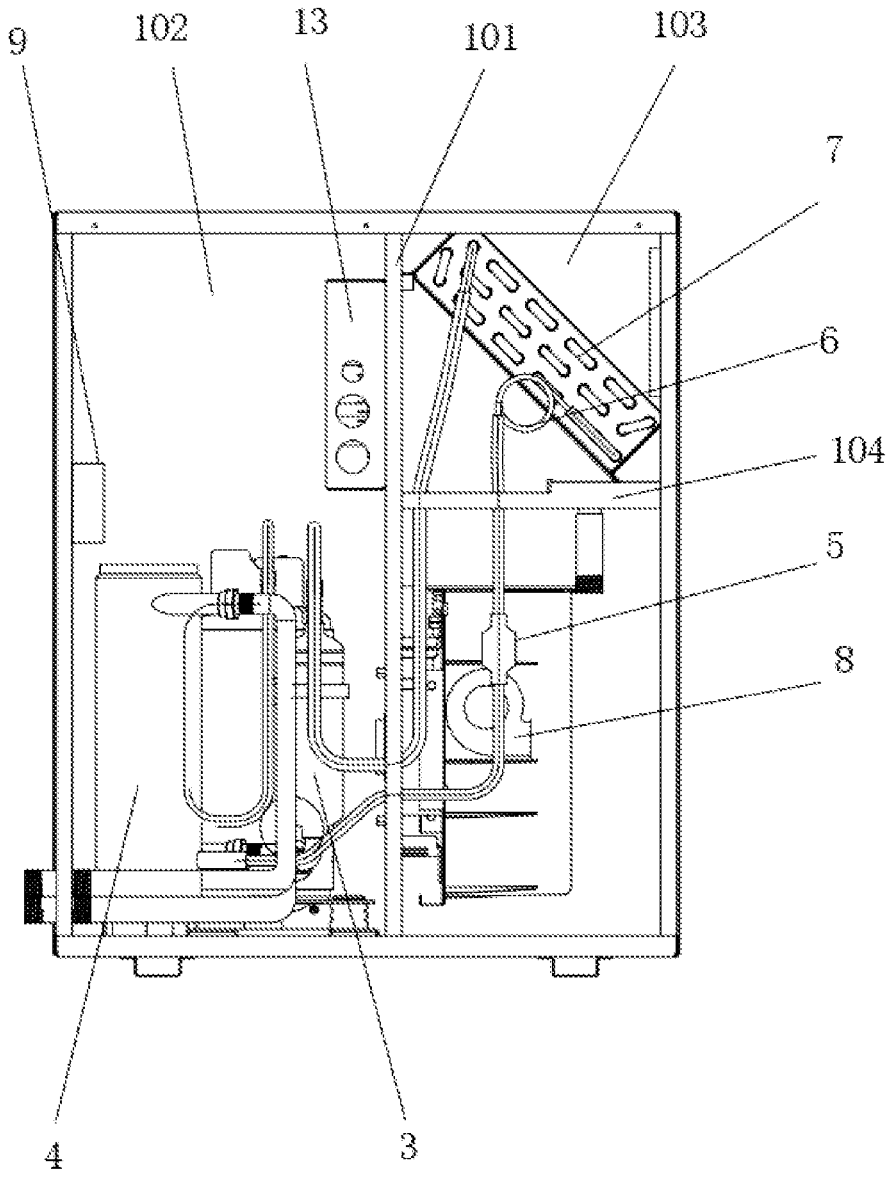
FIG. 2 is a front view of the internal structure of the refrigeration system casing.

As shown in FIG. 2, a longitudinal partition 101 is provided at the middle portion inside the casing 1, dividing the casing 1 into a left chamber 102 and a right chamber 103. A transverse partition 104 is provided at the middle portion of the right chamber 103. The portion above the transverse partition 104 forms an upper right chamber, while the portion below forms a lower right chamber. The left chamber 102 includes a rear lower portion and a front lower portion.

Figure 3:
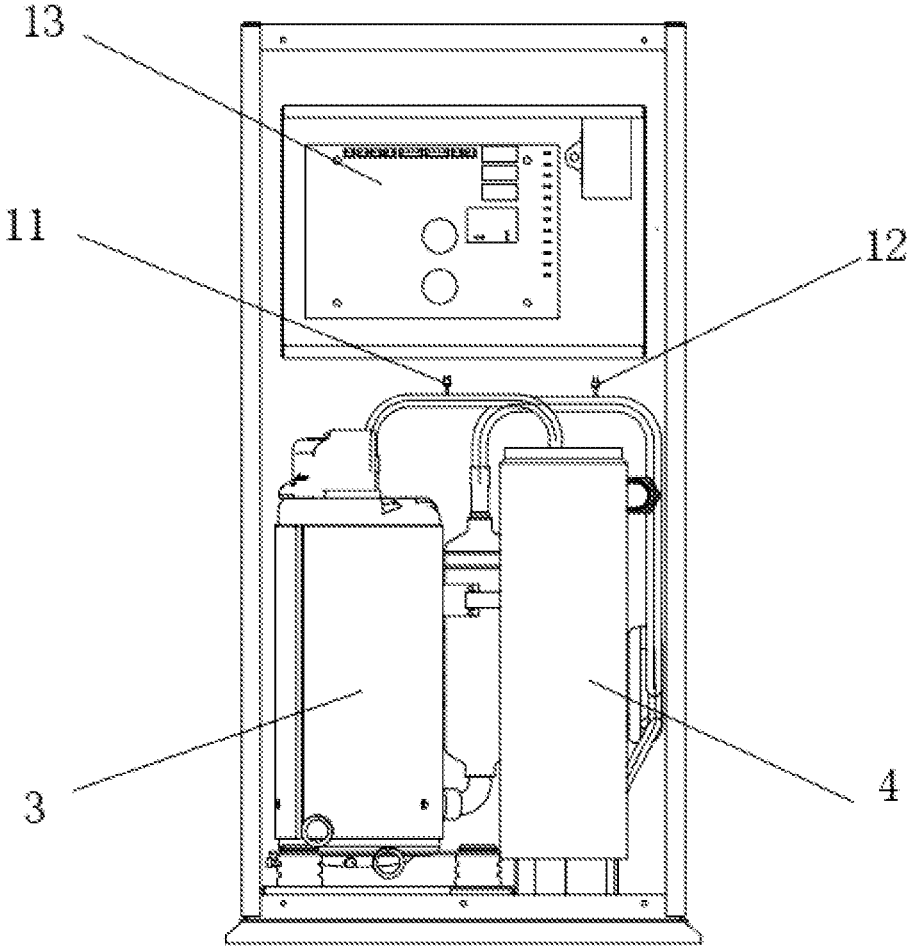
FIG. 3 is a left view of the internal structure of the refrigeration system casing.
Figure 5:
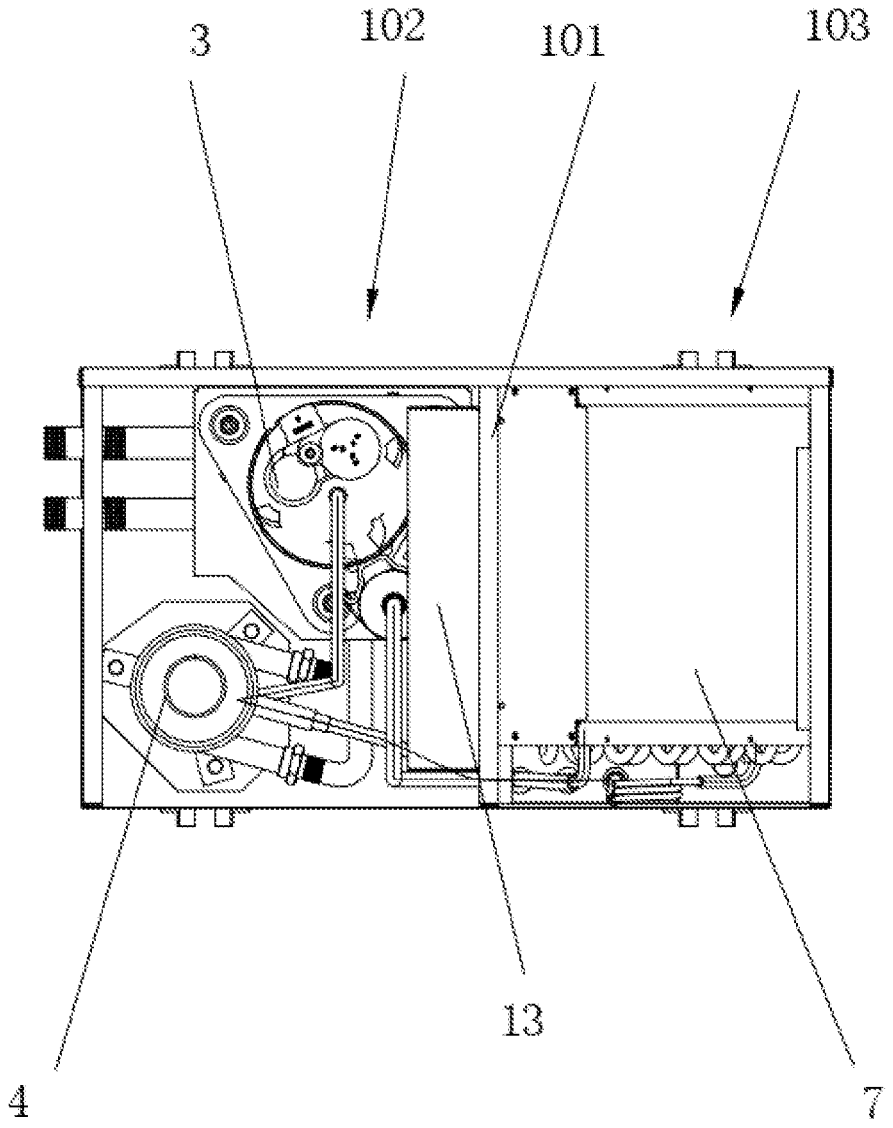
FIG. 5 is a top view of the internal structure of the refrigeration system casing.

As shown in FIGS. 2, 3, and 5, the compressor 3 is arranged in the rear lower portion of the left chamber 102, with its bottom fixed to the bottom of the casing 1. The water-side heat exchanger 4 (i.e., the condenser) is arranged in the front lower portion of the left chamber 102, with its bottom fixed to the bottom of the casing 1. The electronic thermostat 9 is fixed to the left side wall of the left chamber 102. The high-pressure switch 11 is arranged on the refrigerant line between the compressor 3 and the water-side heat exchanger 4 within the left chamber 102. The low-pressure switch 12 is arranged on the refrigerant line between the indoor-side heat exchanger 7 and the compressor 3. The controller 13 is fixed to the inner side wall of the left chamber 102.

Figure 4:
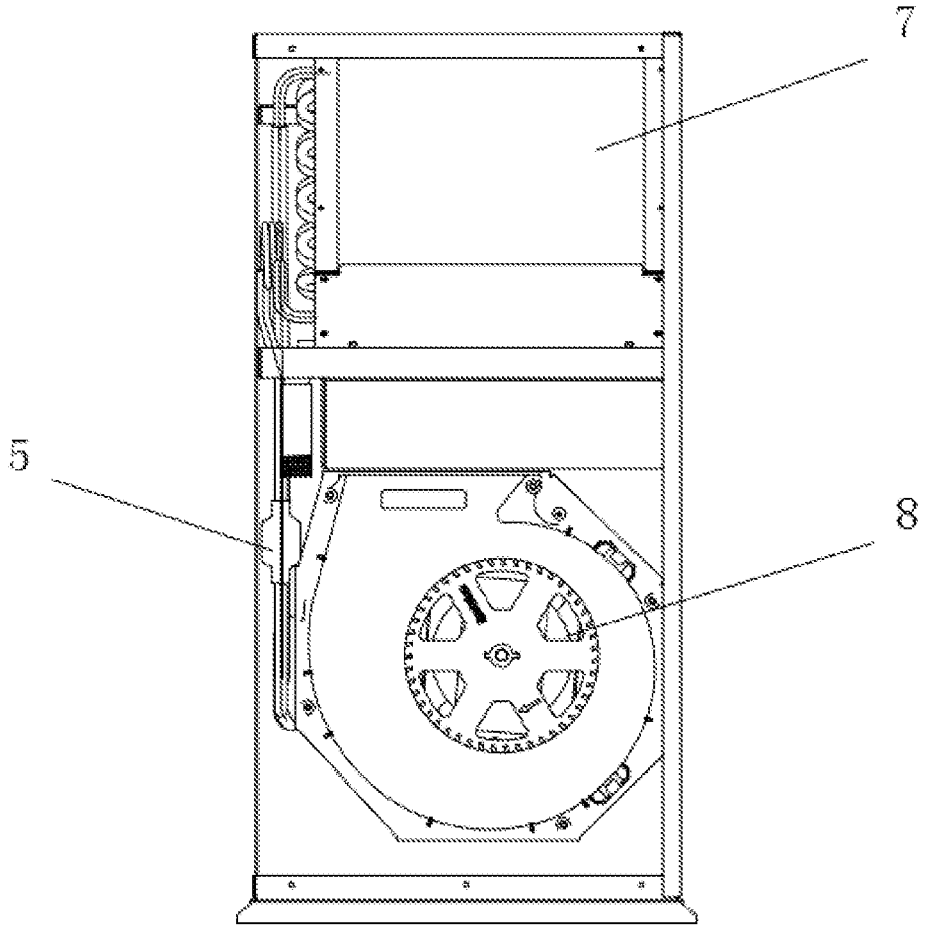
FIG. 4 is a right view of the internal structure of the refrigeration system casing.

As shown in FIGS. 2, 4, and 5, the indoor-side heat exchanger 7 (i.e., the evaporator) is arranged at an incline above the transverse partition 104 in the right chamber 103. The expansion valve 6 is arranged below the indoor-side heat exchanger 7. The filter-drier 5 is arranged in the lower right chamber and is located directly below the expansion valve 6. The indoor fan 8 is fixedly arranged in the lower right chamber.

As shown in FIG. 1, an automatic make-up valve 15 (Model AF0522A) is arranged on the upper side of the thermal storage tank 2. When the water level in the thermal storage tank 2 drops due to hot-water discharge, the automatic make-up valve 15 opens to automatically replenish water from the tap water pipe and closes automatically once replenishment is complete.

As shown in FIG. 1, a domestic hot-water outlet pipe is provided at an upper portion on one side of the thermal storage tank 2, and a motorized valve 16 (Model Q41F-15) is arranged on the pipe. When the water temperature inside the thermal storage tank 2 reaches a preset temperature, opening the motorized valve 16 allows hot water to be discharged for use. A temperature sensor 10 (Model PT-100) is arranged on one side of the motorized valve 16.

As shown in FIG. 1, a blowdown valve 17 (Model DN15) is arranged at a lower portion on one side of the thermal storage tank 2. When sludge accumulates at the bottom of the thermal storage tank 2, opening the blowdown valve 17 allows sludge to be discharged.

As shown in FIG. 1, an electric auxiliary heater 18 (Model EHC15/20-3) is arranged above the blowdown valve 17 near the bottom of one upper portion of the thermal storage tank 2. When the water temperature inside the thermal storage tank 2 fails to reach a preset temperature, the electric auxiliary heater 18 is automatically activated through the controller 13 for heating and is automatically deactivated once the preset temperature is reached.

The compressor 3, the indoor fan 8, the water pump 14, the automatic make-up valve 15, the motorized valve 16, the blowdown valve 17, the electronic thermostat 9, the high-pressure switch 11, and the low-pressure switch 12 are all electrically connected to the controller 13.

The specific working processes of the refrigeration system and the water-side cooling system are as follows:

(1) Refrigeration operation of the refrigeration system based on a Carnot cycle:

Low-temperature and low-pressure gaseous refrigerant is compressed by the compressor to output high-temperature and high-pressure gaseous refrigerant. The refrigerant then enters the water-side heat exchanger and is condensed into high-temperature and high-pressure liquid state. Thereafter, the refrigerant passes through the filter-drier for filtration to prevent clogging of the expansion valve, and is converted by the expansion device into a low-temperature and low-pressure two-phase flow. The refrigerant then enters the indoor evaporator to absorb heat, evaporate, and vaporize into low-temperature and low-pressure gaseous refrigerant, which returns to the compressor for gaseous compression, thereby outputting high-temperature and high-pressure gaseous refrigerant again. In this way, the refrigerant circulates repeatedly to deliver a cold source to the indoor space and achieve the purpose of refrigeration. If, during this cycle, for some reason the refrigeration system experiences an excessively high pressure or an abnormally low pressure that reaches a preset protection value, the high-pressure switch or the low-pressure switch will immediately actuate to cut off the power supply, and the controller will issue a shutdown command to protect the refrigeration system from damage.

(2) Circulating hot-water operation of the water-side cooling system:

As shown in FIG. 6, the water pump is first activated to deliver water from the thermal storage tank into the water-side heat exchanger. Then, the water-side cooling system is started. The high-temperature and high-pressure gaseous refrigerant inside the water-side heat exchanger absorbs heat from the water and is cooled to become high-temperature and high-pressure liquid refrigerant while obtaining a certain degree of subcooling, thereby ensuring stable operation of the unit. The water, after absorbing heat in the water-side heat exchanger and being heated, returns to the thermal storage tank, and this process is repeated.

The water-temperature setting inside the thermal storage tank and the opening and closing of the domestic hot-water motorized valve are controlled by the electronic thermostat. When the temperature sensor detects that the temperature has reached a preset value, for example 35° C., the motorized valve opens, allowing domestic hot water to be used or injected into a user-preset hot-water storage tank (not shown in the figure) for storage. If, due to hot-water discharge, the water level in the thermal storage tank drops to a certain extent, the automatic make-up valve opens to automatically replenish water from the tap water pipe and closes automatically once replenishment is complete.

When the water temperature in the thermal storage tank is lower than a certain preset value, for example 30° C., the electronic thermostat issues a command to close the motorized valve so that domestic hot water cannot be used, although hot water in the user-preset hot-water storage tank may still be used. If the water temperature in the hot-water tank does not meet usage requirements, the electric auxiliary heater is activated to raise the water temperature and automatically cuts off the power supply to stop heating once the required temperature is reached.

The embodiments described above are merely preferred embodiments of the present invention. Any typical variations or substitutions performed by those skilled in the art within the scope of the technical solution of the present invention shall fall within the scope of protection of the present invention.

What is claimed is:

1. A kitchen air conditioning system in which an air conditioner and a thermal storage tank are arranged separately, the system comprising:

a casing;

a refrigeration system;

and a thermal storage tank;

wherein the refrigeration system is installed inside the casing, and comprising a compressor, a water-side heat exchanger, a filter-drier, an expansion valve, an indoor-side heat exchanger, an indoor fan, an electronic thermostat, a temperature sensor, a high-pressure switch, a low-pressure switch, and a controller; the compressor, the high-pressure switch, the water-side heat exchanger, the filter-drier, the expansion valve, the indoor-side heat exchanger, and the low-pressure switch are sequentially connected by refrigerant lines, and the low-pressure switch is further connected to the compressor by a refrigerant line to form a refrigeration cycle;

the water-side heat exchanger is provided with a water outlet A and a water inlet A on one side, and the thermal storage tank is provided with a water outlet B and a water inlet B on one side; the water outlet A and the water inlet B are connected by a water pipe, and water outlet B and the water inlet A are connected by a water pipe; a water pump is provided on the water pipe connecting the water outlet B and the water inlet A;

a longitudinal partition is provided in the middle of the casing to separate the casing into a left chamber and a right chamber; a transverse partition is disposed in a middle portion of the right chamber of the casing; the portion of the right chamber of the casing above the transverse partition is the upper right chamber of the casing, and the portion of the right chamber of the casing below the transverse partition is the lower right chamber of the casing; the left chamber of the casing is provided with a rear lower portion and a front lower portion;

the compressor is provided in the rear lower portion of the left chamber of the casing; bottom of the compressor is fixedly arranged on the bottom of the casing; the water-side heat exchanger is provided in the front lower portion of the left chamber of the casing; a bottom of the water-side heat exchanger is fixedly arranged on bottom of the casing; the electronic thermostat is fixedly arranged on the left side wall of a left chamber of the casing; the high-pressure switch is provided on the refrigerant line between the compressor and the water-side heat exchanger in the left chamber of the casing; the low-pressure switch is provided on the refrigerant line between the indoor-side heat exchanger and the compressor in the left chamber of the casing; and the controller is fixedly arranged on an inner side wall of the left chamber of the casing;

the indoor-side heat exchanger is obliquely arranged above the transverse partition in the right chamber of the casing; the expansion valve is provided below the indoor-side heat exchanger; the filter-drier is provided in a lower right chamber of the casing, and the filter-drier is located directly below the expansion valve within the lower right chamber of the casing; and the indoor fan is arranged in the lower right chamber of the casing; and the kitchen air conditioning system further comprises an automatic make-up valve, a motorized valve, and a blowdown valve; the compressor, the indoor fan, the water pump, the automatic make-up valve, the motorized valve, the blowdown valve, the electronic thermostat, the high-pressure switch, and the low-pressure switch are all electrically connected to the controller; and the opening and closing of the motorized valve are controlled by the electronic thermostat so that the electronic thermostat is electrically connected with the motorized valve.

2. The kitchen air conditioning system according to claim 1, wherein an automatic make-up valve is provided on an upper side of the thermal storage tank.

3. The kitchen air conditioning system according to claim 1, wherein a domestic hot-water outlet pipe is provided on an upper location on one side of the thermal storage tank, a motorized valve is provided on the domestic hot water outlet pipe, and a temperature sensor is provided on one side of the motorized valve; wherein, when a water temperature inside the thermal storage tank reaches a preset temperature, opening the motorized valve allows hot water to be discharged for use.

4. The kitchen air conditioning system according to claim 1, wherein a blowdown valve is provided on a lower portion on one side of the thermal storage tank; wherein, when sludge is deposited at a bottom of the thermal storage tank, opening the blowdown valve allows the sludge to be discharged.

5. The kitchen air conditioning system according to claim 4, wherein an electric auxiliary heater is disposed above the blowdown valve on a bottom of an upper side of the thermal storage tank; wherein, when a water temperature inside the thermal storage tank fails to reach a preset value, the electric auxiliary heater is automatically activated through the controller to perform heating, and when the water temperature reaches the preset value, the electric auxiliary heater is automatically deactivated.

6. The kitchen air conditioning system according to claim 4, wherein an electric auxiliary heater is disposed on one side at a bottom portion of the thermal storage tank and located above the blowdown valve; wherein, when a water temperature inside the thermal storage tank is lower than a preset value, the controller automatically activates the electric auxiliary heater to perform heating, and when the water temperature reaches the preset value, the controller automatically deactivates the electric auxiliary heater.

7. The kitchen air conditioning system according to claim 1, wherein specific working processes of the refrigeration system and a water-side cooling system are as follows:

(1) in a refrigeration operation of the refrigeration system based on a Carnot cycle, low-temperature and low-pressure gaseous refrigerant is compressed by the compressor to output high-temperature and high-pressure gaseous refrigerant, the refrigerant enters the water-side heat exchanger and is condensed into high-temperature and high-pressure liquid refrigerant, then passes through the filter-drier for filtration to prevent clogging of the expansion valve, is converted by the expansion valve into low-temperature and low-pressure two-phase flow, enters an indoor evaporator to absorb heat and evaporate and vaporize into low-temperature and low-pressure gaseous refrigerant, and then returns to the compressor for gaseous compression to again output high-temperature and high-pressure gaseous refrigerant, thereby repeatedly circulating to deliver a cold source to an indoor space and achieve refrigeration; and (2) in a circulating hot-water operation of the water-side cooling system, the water pump is first activated to deliver water from the thermal storage tank into the water-side heat exchanger, then the water-side cooling system is started, such that high-temperature and high-pressure gaseous refrigerant inside the water-side heat exchanger absorbs heat from the water and is cooled to become high-temperature and high-pressure liquid refrigerant while obtaining a certain degree of subcooling to ensure stable operation of a unit, and water, after absorbing heat in the water-side heat exchanger and being heated, returns to the thermal storage tank to form a repeated cycle; wherein water-temperature setting in the thermal storage tank and opening and closing of the domestic hot-water motorized valve are controlled by the electronic thermostat such that, when the temperature sensor detects that temperature reaches a preset value, the motorized valve opens to allow domestic hot water to be used or injected into a hot-water storage tank for storage and wherein, when a water temperature in the thermal storage tank is lower than a preset value, the electronic thermostat issues a command to close the motorized valve so that domestic hot water cannot be used, but hot water in the hot-water storage tank can still be used, and if a water temperature in the hot-water tank does not meet usage requirements, the electric auxiliary heater is activated to raise the water temperature and automatically cuts off the power supply to stop heating once a required temperature is reached.

* * * * *